US009451354B2

(12) United States Patent
Zadesky et al.

(10) Patent No.: US 9,451,354 B2
(45) Date of Patent: Sep. 20, 2016

(54) LIQUID EXPULSION FROM AN ORIFICE

(71) Applicant: Apple Inc., Cupertino, CA (US)

(72) Inventors: Stephen P. Zadesky, Cupertino, CA (US); Fletcher R. Rothkopf, Cupertino, CA (US); Ashley E. Fletcher, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 71 days.

(21) Appl. No.: 14/275,065

(22) Filed: May 12, 2014

(65) Prior Publication Data

US 2015/0326959 A1 Nov. 12, 2015

(51) Int. Cl.

| | |
|---|---|
| ***H04R 1/02*** | (2006.01) |
| ***H04R 1/12*** | (2006.01) |
| ***H04R 1/00*** | (2006.01) |
| ***H04R 1/08*** | (2006.01) |

(52) U.S. Cl.

CPC *H04R 1/12* (2013.01); *H04R 1/00* (2013.01); *H04R 1/083* (2013.01)

(58) Field of Classification Search

CPC ..... H04R 2499/11; H04R 5/02
USPC ..... 381/334
See application file for complete search history.

(56) References Cited

U.S. PATENT DOCUMENTS

| | | | |
|---|---|---|---|
| 1,276,708 | A | 8/1918 | Blair |
| 1,646,628 | A | 10/1927 | Nolen |
| 1,893,291 | A | 1/1933 | Kwartin |
| 1,992,605 | A | 2/1935 | Clifford et al. |
| 2,325,688 | A | 7/1943 | Landis |
| 2,779,095 | A | 1/1957 | Hottenroth, Jr. |
| 3,414,689 | A | 12/1968 | Gummel et al. |
| 3,866,299 | A | 2/1975 | Gregg et al. |
| 4,068,103 | A | 1/1978 | King et al. |
| 4,081,631 | A | 3/1978 | Feder |
| 4,089,576 | A | 5/1978 | Barchet |
| 4,132,437 | A | 1/1979 | Green |
| 4,245,642 | A | 1/1981 | Skubitz et al. |
| 4,466,441 | A | 8/1984 | Skubitz et al. |

(Continued)

FOREIGN PATENT DOCUMENTS

| | | |
|---|---|---|
| CN | 204104134 | 1/2015 |
| EP | 2094032 | 8/2009 |

(Continued)

OTHER PUBLICATIONS

Baechtle et al., "Adjustable Audio Indicator," IBM, 2 pages, Jul. 1, 1984.

(Continued)

*Primary Examiner* — Simon King
(74) *Attorney, Agent, or Firm* — Brownstein Hyatt Farber Schreck, LLP

(57) ABSTRACT

A device having one or more an acoustic modules. The acoustic module includes an acoustic element and a cavity that is acoustically coupled to the acoustic element. The module also includes a first conductive element that is configured to generate a first surface charge on a first region of an interior surface of the cavity. A second conductive element is configured to generate a second surface charge on a second region of the interior surface of the cavity. The first and second charge on the first and second regions of the interior surfaces of the cavity may be selectively applied to facilitate movement of a liquid held within the cavity.

20 Claims, 7 Drawing Sheets

SECTION A-A

(56) References Cited

U.S. PATENT DOCUMENTS 4,658,425 A 4/1987 Julstrom
5,106,318 A 4/1992 Endo et al.
5,293,002 A 3/1994 Grenet et al.
5,335,011 A 8/1994 Addeo et al.
5,406,038 A 4/1995 Reiff et al.
5,521,886 A 5/1996 Hirosawa et al.
5,570,324 A 10/1996 Geil
5,604,329 A 2/1997 Kressner et al.
5,619,583 A 4/1997 Page et al.
5,733,153 A 3/1998 Takahashi et al.
5,879,598 A 3/1999 McGrane
5,958,203 A * 9/1999 Parce ..... B01F 13/0071 204/451
6,036,554 A 3/2000 Koeda et al.
6,073,033 A 6/2000 Campo
6,129,582 A 10/2000 Wilhite et al.
6,151,401 A 11/2000 Annaratone
6,154,551 A 11/2000 Frenkel
6,192,253 B1 2/2001 Charlier et al.
6,317,237 B1 11/2001 Nakao et al.
6,370,005 B1 * 4/2002 Sun ..... H02N 13/00 361/234
6,400,825 B1 6/2002 Miyamoto et al.
6,516,077 B1 2/2003 Yamaguchi et al.
6,553,126 B2 4/2003 Han et al.
6,700,987 B2 3/2004 Kuze et al.
6,813,218 B1 11/2004 Antonelli et al.
6,829,018 B2 12/2004 Lin et al.
6,882,335 B2 4/2005 Saarinen
6,892,850 B2 5/2005 Suzuki et al.
6,924,792 B1 * 8/2005 Jessop ..... G02B 26/002 345/105
6,934,394 B1 8/2005 Anderson
6,942,771 B1 * 9/2005 Kayyem ..... B01L 3/5027 204/409
7,003,099 B1 2/2006 Zhang et al.
7,059,932 B1 6/2006 Tobias et al.
7,082,322 B2 7/2006 Harano
7,116,795 B2 10/2006 Tuason et al.
7,154,526 B2 12/2006 Foote et al.
7,158,647 B2 1/2007 Azima et al.
7,181,030 B2 2/2007 Rasmussen et al.
7,263,373 B2 8/2007 Mattisson
7,266,189 B1 9/2007 Day
7,362,877 B2 4/2008 Honda et al.
7,378,963 B1 5/2008 Begault et al.
7,527,523 B2 5/2009 Yohn et al.
7,536,029 B2 5/2009 Choi et al.
7,570,772 B2 8/2009 Sorensen et al.
7,679,923 B2 3/2010 Inagaki et al.
7,792,320 B2 9/2010 Proni
7,867,001 B2 1/2011 Ambo et al.
7,878,869 B2 2/2011 Murano et al.
7,903,061 B2 3/2011 Zhang et al.
7,912,242 B2 3/2011 Hikichi
7,966,785 B2 6/2011 Zadesky et al.
8,031,853 B2 10/2011 Bathurst et al.
8,055,003 B2 11/2011 Mittleman et al.
8,116,505 B2 2/2012 Kawasaki-Hedges et al.
8,116,506 B2 2/2012 Kuroda et al.
8,161,890 B2 4/2012 Wang
8,204,266 B2 6/2012 Frigola Munoz et al.
8,218,397 B2 7/2012 Chan
8,226,446 B2 7/2012 Kondo et al.
8,264,777 B2 9/2012 Skipor et al.
8,286,319 B2 10/2012 Stolle et al.
8,340,312 B2 12/2012 Johnson et al.
8,409,417 B2 4/2013 Wu
8,417,298 B2 4/2013 Mittleman et al.
8,447,054 B2 5/2013 Bharatan et al.
8,452,037 B2 5/2013 Filson et al.
8,488,817 B2 7/2013 Mittleman et al.
8,508,908 B2 8/2013 Jewell-Larsen
8,560,309 B2 10/2013 Pance et al.
8,574,004 B1 11/2013 Tarchinski et al.
8,620,162 B2 12/2013 Mittleman
8,632,670 B2 1/2014 Garimella et al.
8,644,519 B2 2/2014 Pance et al.
8,644,533 B2 2/2014 Burns
8,693,698 B2 4/2014 Carnes et al.
8,724,841 B2 5/2014 Bright et al.
8,804,993 B2 8/2014 Shukla et al.
8,983,097 B2 3/2015 Dehe et al.
2003/0087292 A1 * 5/2003 Chen ..... B01F 5/061 435/6.12
2004/0203520 A1 10/2004 Schirtzinger et al.
2005/0009004 A1 * 1/2005 Xu ..... G01N 33/48728 435/4
2005/0271216 A1 12/2005 Lashkari
2006/0072248 A1 4/2006 Watanabe et al.
2007/0012827 A1 1/2007 Fu et al.
2008/0204379 A1 8/2008 Perez-Noguera
2008/0251383 A1 * 10/2008 Sobek ..... B01L 3/502738 204/643
2008/0260188 A1 10/2008 Kim
2008/0292112 A1 11/2008 Valenzuela et al.
2008/0310663 A1 12/2008 Shirasaka et al.
2009/0045005 A1 2/2009 Byon et al.
2011/0002487 A1 1/2011 Panther et al.
2012/0250928 A1 10/2012 Pance et al.
2012/0263019 A1 10/2012 Armstong-Muntner
2012/0268857 A1 * 10/2012 Jewell-Larsen ..... G06F 1/20 361/231
2013/0017738 A1 1/2013 Asakuma et al.
2013/0051601 A1 2/2013 Hill et al.
2013/0129122 A1 5/2013 Johnson et al.
2013/0164999 A1 6/2013 Ge et al.
2013/0259281 A1 10/2013 Filson et al.
2013/0280965 A1 10/2013 Kojyo
2014/0028243 A1 * 1/2014 Rayner ..... G06F 1/163 320/103
2014/0093113 A1 4/2014 Dix et al.
2014/0105440 A1 4/2014 Mittleman et al.
2014/0113478 A1 4/2014 Yeung et al.
2014/0140558 A1 5/2014 Kwong
2014/0226826 A1 8/2014 Utterman et al.
2014/0250657 A1 9/2014 Stanley et al.
2015/0060110 A1 * 3/2015 Merz ..... C23C 16/042 174/251
2015/0078611 A1 3/2015 Boozer et al.

FOREIGN PATENT DOCUMENTS

GB 2310559 8/1997
GB 2342802 4/2000
JP 2102905 4/1990
JP 2003319490 11/2003
JP 2004153018 5/2004
JP 2006297828 11/2006
WO WO03/049494 6/2003
WO WO2004/025938 3/2004
WO WO2007/083894 7/2007
WO WO2008/153639 12/2008
WO WO2009/017280 2/2009
WO WO2011/057346 5/2011
WO WO2011/061483 5/2011

OTHER PUBLICATIONS

Blankenbach et al., "Bistable Electrowetting Displays," https://spie.org/x43687.xml, 3 pages, Jan. 3, 2011.
Pingali et al., "Audio-Visual Tracking for Natural Interactivity," Bell Laboratories, Lucent Technologies, pp. 373-382, Oct. 1999.
Zhou et al., "Electrostatic Graphene Loudspeaker," Applied Physics Letters, vol. 102, No. 223109, 5 pages, Dec. 6, 2012.

* cited by examiner

SECTION A-A

SECTION A-A

LIQUID EXPULSION FROM AN ORIFICE

TECHNICAL FIELD

This disclosure relates generally to acoustic modules, and more specifically to expulsion of liquid from an acoustic cavity of an acoustic module.

BACKGROUND

An acoustic module integrated into a device can be used to transmit or receive acoustic signals. In a typical device, the acoustic signals are transmitted to or received from a surrounding medium (e.g., air). To facilitate communication with the surrounding medium, the acoustic module may be partially exposed to the environment surrounding the device via one or more orifices or openings.

In some cases, an acoustic module may include one or more components that are disposed within a cavity or chamber to help protect the components from the external environment. In some cases, the components may be acoustically coupled to the cavity to produce a particular acoustic response. Typically, at least some portion of the cavity or chamber is exposed to the external environment to allow acoustic signals to be transmitted to or received from the surrounding medium. However, because the cavity or chamber is exposed to the external environment, liquid or moisture may accumulate or become trapped in the cavity or chamber, which may impair the performance of the acoustic module.

Thus, it is generally desirable to prevent the ingress of moisture into an acoustic module. However, in some cases, the complete prevention of liquid ingress is not possible or practical. Thus, there may be a need for a system and technique for evacuating or removing moisture that has entered or accumulated in an acoustic module.

SUMMARY

The embodiments described herein are directed to an acoustic module that is configured to remove all or a portion of a liquid that has accumulated within a cavity of the acoustic modules. In one example embodiment, the acoustic modules includes an acoustic element and a cavity that is acoustically coupled to the acoustic element. The module also includes a first conductive element configured to generate a first surface charge on a first region of an interior surface of the cavity, and a second conductive element configured to generate a second surface charge on a second region of the interior surface of the cavity. In some cases, the first and second charge on the first and second regions of the interior surfaces of the cavity may be selectively applied to facilitate movement of a liquid held within the cavity. In some embodiments, the acoustic module is incorporated into an electronic device.

In one example, the first conductive element is formed from a first electrode that is proximate to an interior surface of the cavity, and the second conductive element is formed from a second electrode that is proximate to an interior surface of the cavity and proximate to the first electrode. In some cases, the first and second electrodes are separated from the interior surface of the cavity by a dielectric layer.

In one example, the first charge is a positive charge resulting in a decrease in the hydrophobicity of the first region of the interior of the surface of the cavity. In this case, the first charge may facilitate movement of the liquid toward the first region of the interior surface of the cavity. In some cases, the second charge is a negative charge resulting in an increase in the hydrophobicity of the second region of the interior of the surface of the cavity. One or both of the first and second charges may facilitate movement of the liquid toward the first region of the interior surface of the cavity.

In one example embodiment, the first and second conductive elements are located on a lower surface of the cavity. The acoustic module may also include a third conductive element configured to generate a first surface charge on a third region of an interior surface of the cavity. The third conductive element may be located on an upper surface of the cavity. The module may also include a fourth conductive element configured to generate a fourth surface charge on a fourth region of the interior surface of the cavity. In some cases, the first, second, third, and fourth charges may be selectively applied to facilitate movement of a liquid held within the cavity.

In one example embodiment, the first and second conductive elements are formed from an electrode that substantially conforms to the shape of the cavity. The first and second conductive elements may be coil elements formed from a coil of conductive wire. In some cases, the acoustic element is a speaker element. In some cases, the acoustic element is a microphone element. In one example embodiment, the speaker element or the microphone element is configured to generate an acoustic pulse that facilitates movement of the liquid within the cavity.

In one example embodiment, the module also includes a screen element located at an opening in the cavity. The screen element may be configured to selectively apply a surface charge to a surface of the screen element to modify the hydrophobicity of the surface of the screen element.

DETAILED DESCRIPTION

The description that follows includes example systems and processes that embody various elements of the present disclosure. However, it should be understood that the described disclosure may be practiced in a variety of forms in addition to those described herein.

The present disclosure includes systems, techniques, and apparatuses for expelling liquid from a cavity of an acoustic module through an orifice or opening of the module. In one example, the hydrophobicity of one or more elements of the acoustic module may be varied by varying the electric charge on the one or more elements of the acoustic module. In some implementations, the electric charge may be varied on a series of elements, facilitating movement of a liquid held within the cavity. Additionally, the acoustic module, which may include a speaker mechanism, may be configured to produce acoustic waves that also facilitate expulsion of liquid from the acoustic module.

Additionally, in some cases, an acoustic sensor (e.g., a microphone) may be used to detect the presence of liquid or quantify the amount of liquid in the acoustic cavity. For example, an acoustic module may generate a calibrated tone or stimulus that results in an acoustic signal that is received by the acoustic sensor. The presence of liquid and/or the amount of liquid may be determined based on the acoustic signal received by the acoustic sensor. In some cases, additional liquid expulsion operations may be performed in response to this determination.

Figure 1A:
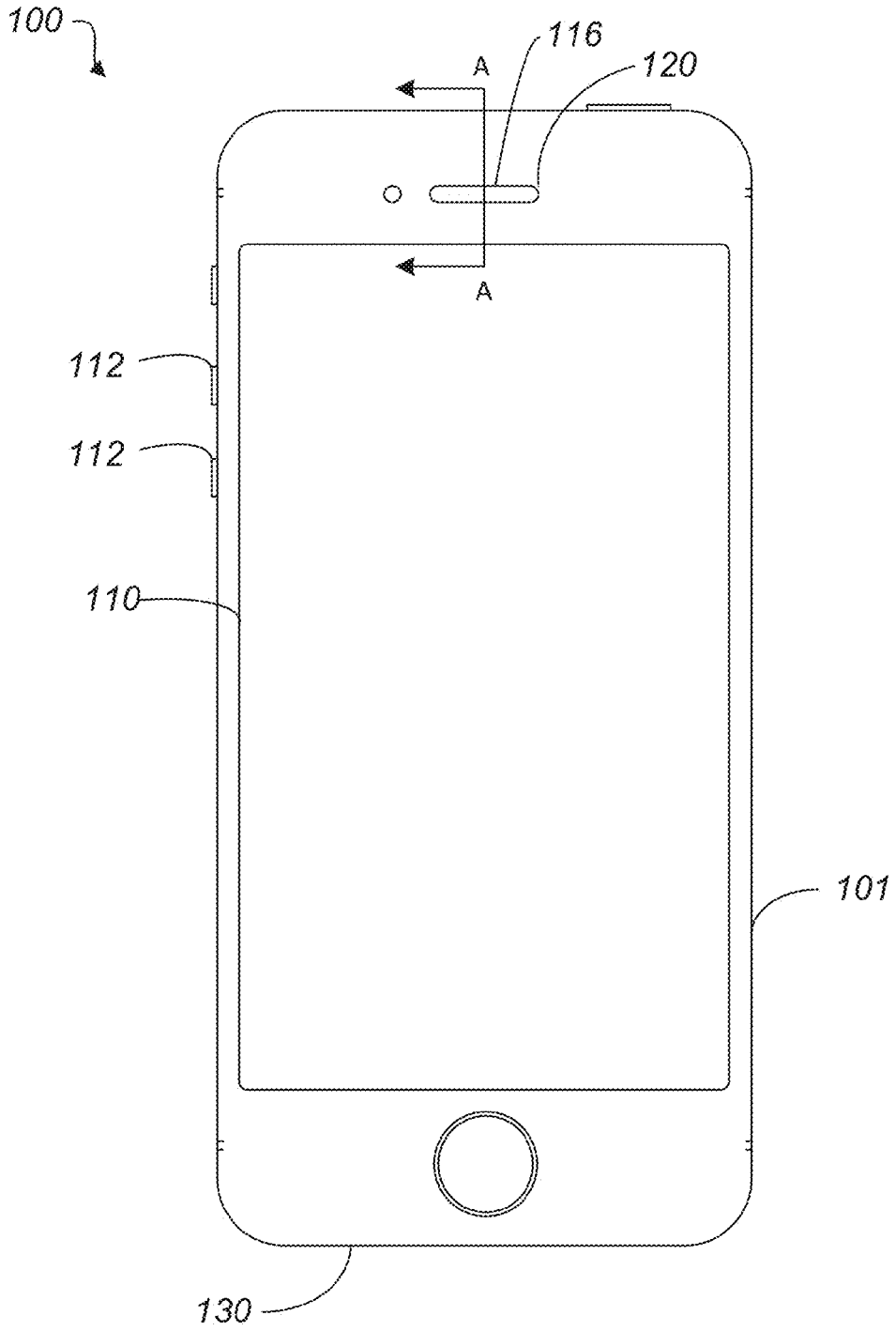
FIGS. 1A-B depict an example electronic device having at least one acoustic module.
Figure 1B:
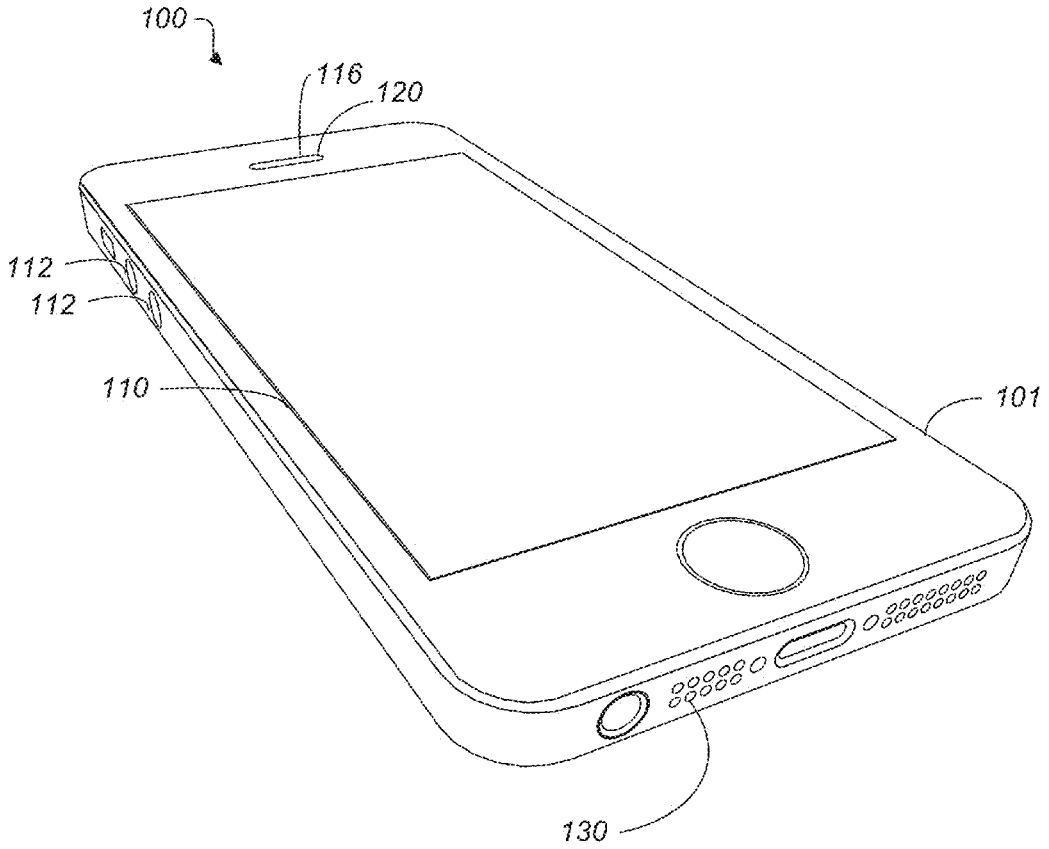

FIGS. 1A-B depict an example device 100 including an acoustic module. In this example, the device 100 is a mobile telephone having a touch screen display 110. The touch screen display 110 is an interface for the user to provide input to the device as well as present visual output to the user. In this example, the device 100 also includes interface buttons 112 for providing additional input to the device 100.

As shown in FIGS. 1A-B, the device 100 includes a housing 101 used to protect the internal components of the device 100. The housing 101 may be formed from a substantially rigid shell structure that serves as the mechanical support for various components of the device 100, including the touch screen display 110, the interface buttons 112, and one or more acoustic modules (depicted in FIG. 2).

Figure 3A:
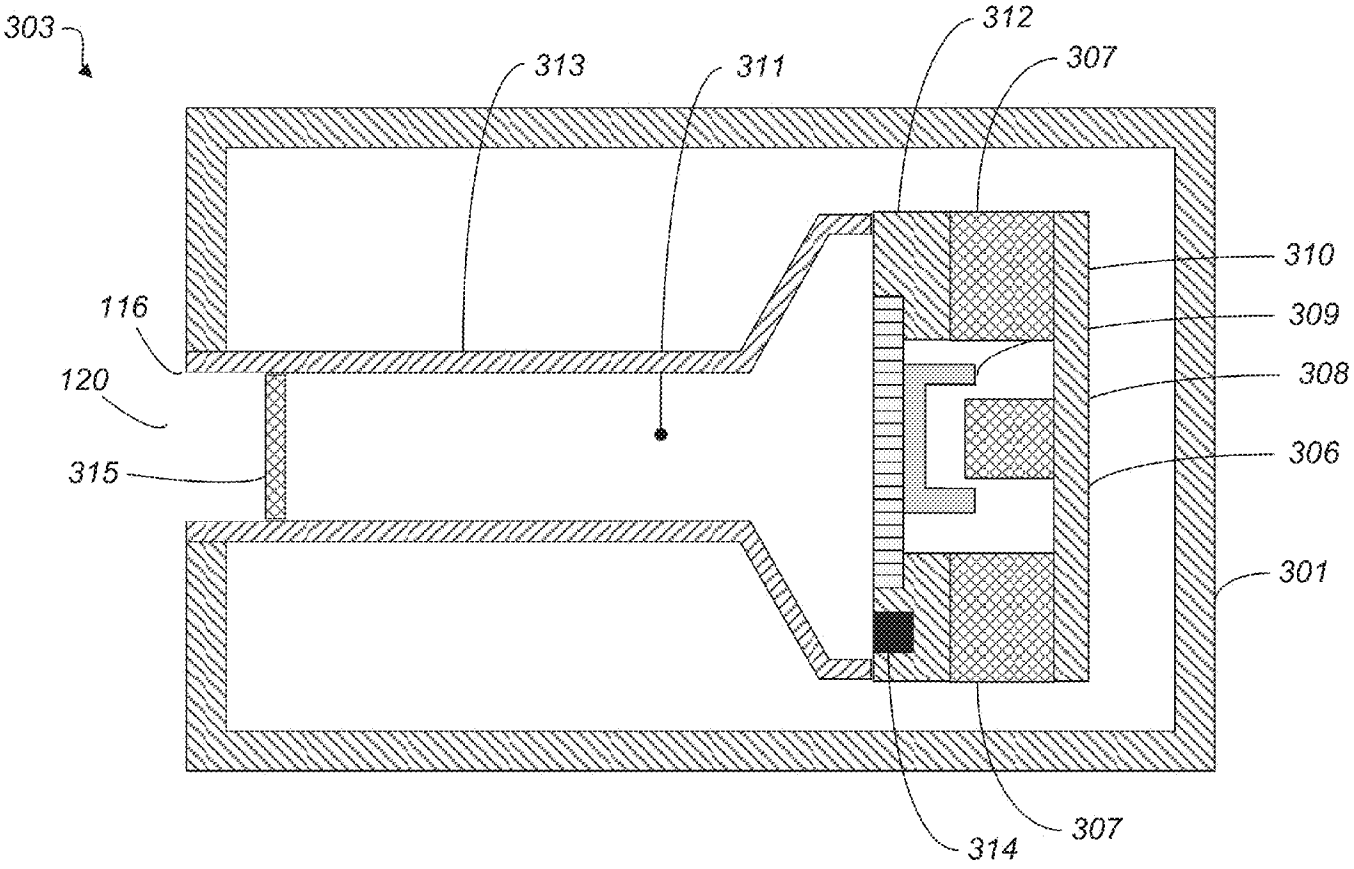
FIG. 3A depicts a cross-sectional view of an example acoustic module taken along section A-A of FIG. 1A.
Figure 3B:
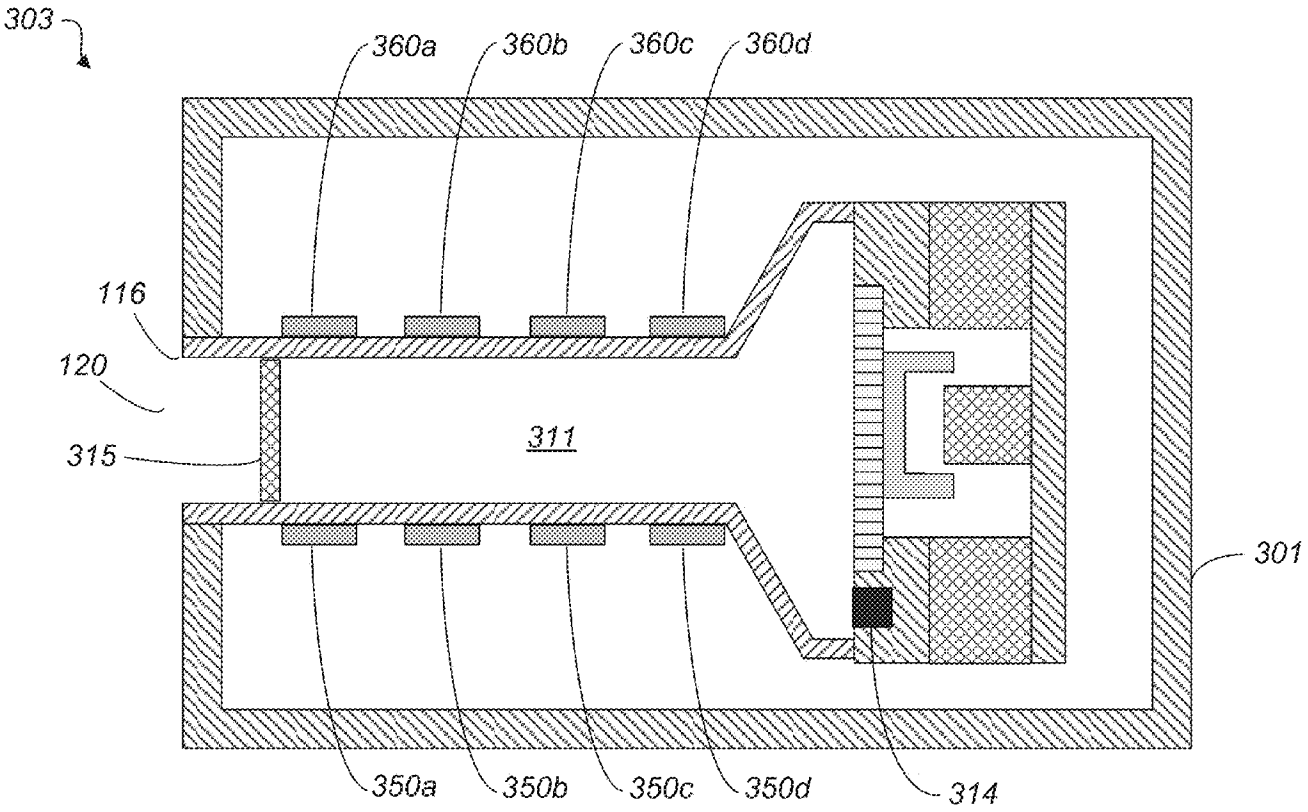
FIG. 3B depicts a cross-sectional view of an example acoustic module having conductive elements for expelling liquid from the acoustic module taken along section A-A of FIG. 1A.

As shown in FIGS. 1A-B, the housing 101 includes a first acoustic port 120 that is coupled to a speaker acoustic module. In this example, the speaker acoustic module is configured to function as an earpiece or speaker for the mobile telephone. An example acoustic module 303 is provided in FIGS. 3A-B depicting a cross-sectional view of a speaker acoustic module taken along section A-A of FIG. 1A. The first acoustic port 120 includes an opening that facilitates the transmission of audible signals from the speaker to the user's ear. In this example, the acoustic port includes an orifice 116 through the housing 101 that connect internal components of the acoustic module with the external environment. In other examples, a single acoustic port may include multiple orifices. As described in more detail with respect to FIG. 3, the first acoustic port 120 may also include a screen mesh or other protective element configured to inhibit ingress of liquid or other foreign matter. The housing 101 also includes a second acoustic port 130 that is coupled to a microphone acoustic module that is configured to function as a mouthpiece or microphone for the mobile telephone. The second acoustic port 130 also includes one or more openings or orifices to facilitate the transmission of sound from the user to the microphone acoustic module, which may include a screen mesh or protective element to inhibit ingress of liquid or other foreign matter.

In this example, the device 100 is a smart phone. However, it is understood that the device 100 depicted in FIGS. 1A-B is simply one example and that other types of devices may include an acoustic module. Other types of devices include, without limitation, a laptop computer, a desktop computer, a cellular phone, a digital media player, a wearable device, a health-monitoring device, a tablet computer, a mobile computer, a telephone, and/or other electronic device.

Figure 2:
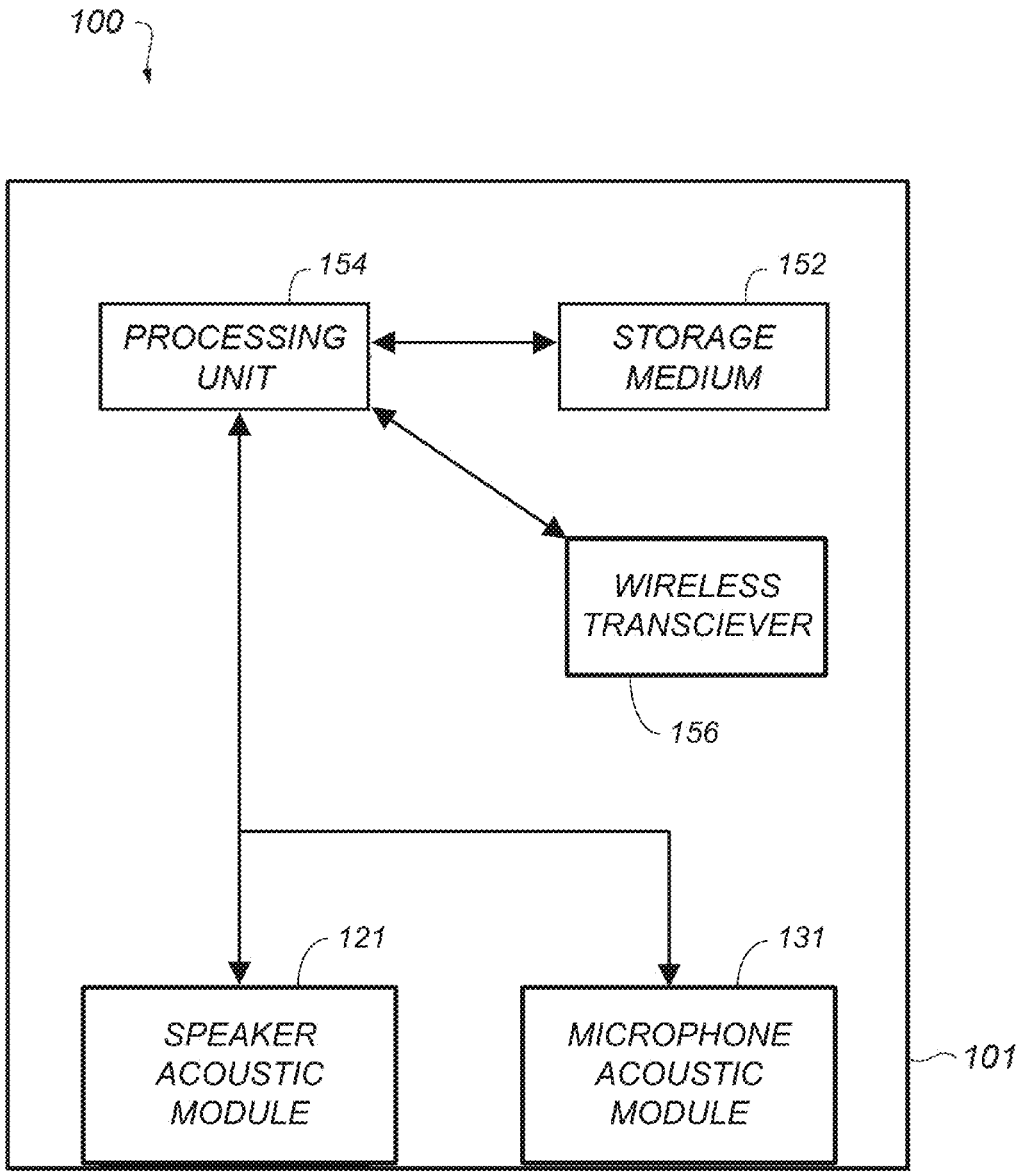
FIG. 2 depicts a block diagram of example functional components of an electronic device having at least one acoustic module.

FIG. 2 depicts a schematic diagram of example components of the device 100 that are located within the housing 101. As shown in FIG. 2, the device 100 may include one or more processing units 154, one or more non-transitory storage media 152, one or more speaker acoustic modules 121, and/or one or more microphone acoustic modules 131. In this example, the processing unit includes a computer processor that is configured to execute computer-readable instructions to perform one or more electronic device functions. The computer-readable instructions may be stored on the non-transitory storage media 152, which may include, without limitation: a magnetic storage medium; optical storage medium; magneto-optical storage medium; read only memory; random access memory; erasable programmable memory; flash memory; and the like.

As shown in FIG. 2, device 100 may also include two acoustic modules: a speaker acoustic module 121 and a microphone acoustic module 131. The acoustic modules 121, 131 are coupled to respective acoustic ports (items 120 and 130 of FIGS. 1A-B). The acoustic modules 121, 131 are configured to transmit and/or receive signals in response to a command or control signal provided by the processing unit 154. In some cases, intermediate circuitry may facilitate the electrical interface between the processing unit 154 and the acoustic modules 121, 131.

Although FIG. 2 illustrates the device 100 as including particular components, this is provided only as an example. In various implementations, the device 100 may include additional components beyond those shown and/or may not include some components shown without departing from the scope of the present disclosure. For example, the device may include only one of a speaker acoustic module 121 and a microphone acoustic module 131. Alternatively, the device may include additional acoustic modules or other types of acoustic modules FIG. 3A depicts a simplified schematic cross-sectional view of a first embodiment of a device having an acoustic module 303. The cross-sectional view of FIG. 3A is taken along section A-A of FIG. 1A. The cross-sectional view of FIG. 3A is not drawn to scale and may omit some elements for clarity. The acoustic module 303 may be, for example, a speaker acoustic module of an electronic device (See, e.g., item 121 of FIG. 2). The electronic device may include a housing 301 in which the acoustic port 120 is formed. In the present example, the acoustic port includes a single passage or orifice 116 connecting the acoustic cavity 311 of the acoustic module 303 to an environment external to the electronic device. In other examples, a single port may include multiple orifices. A screen element 315 may separate the acoustic cavity from the external environment and may impede the ingress of liquids or other foreign material from the external environment into the acoustic module 303.

In the present example depicted in FIG. 3A, the acoustic module 303 is a speaker module. As shown in FIG. 3A, a speaker acoustic module includes various components for producing and transmitting sound, including a diaphragm 310, a voice coil 309, a center magnet 308, and side magnets/coils 307. In a typical implementation, the diaphragm 310 is configured to produce sound waves or an acoustic signal in response to a stimulus signal in the voice coil 309. That is, a modulated stimulus signal in the voice coil 309 causes movement of the center magnet 308, which is coupled to the diaphragm 310. Movement of the diaphragm 310 creates the sound waves, which propagate through the acoustic cavity 311 of acoustic module 303 and eventually out the acoustic port 120 to a region external to the device. In some cases, the acoustic cavity 311 functions as an acoustical resonator having a shape and size that is configured to amplify and/or dampen sound waves produced by movement of the diaphragm 310.

As shown in FIG. 3A, the acoustic module 303 also includes a yoke 306, connector elements 312, and a cavity wall 313. These elements provide the physical support of the speaker elements. Additionally, the connector elements 312 and the cavity wall 313 together form the partially enclosed acoustic cavity 311. The specific structural configuration of FIG. 3A is not intended to be limiting. For example, in alternative embodiments, the acoustic cavity may be formed from additional components or may be formed from a single component.

The acoustic module 303 depicted in FIG. 3A is provided as one example of a type of speaker acoustic module. In other alternative implementations, the speaker module may include different configurations for producing and transmitting sound, including, for example, a vibrating membrane, piezoelectric transducer, vibrating ribbon, or the like. Additionally, in other alternative implementations, the acoustic module may be a microphone acoustic module having one or more elements for converting acoustic energy into an electrical impulse. For example, the acoustic module may alternatively include a piezoelectric microphone element for producing a charge in response to acoustic energy or sound.

As previously mentioned, because the acoustic port 120 connects the acoustic module 303 to the external environment, there is a possibility that liquid may accumulate or infiltrate the interior of the module. In some cases, even with the screen element 315 or other protective elements in place, liquid may enter the acoustic cavity 311 of the module. For example, if the device is immersed in a liquid or subjected to a liquid under pressure, some liquid ingress may occur. Additionally, naturally occurring moisture in the air may condense and accumulate over time resulting in the presence of liquid within the module. In such cases, the accumulation of liquid in, for example, the acoustic cavity 311, may affect the performance of the acoustic module 303 by changing the acoustic dynamics of the cavity 311, diaphragm 310, or other elements of the acoustic module 303.

Thus, in some implementations, the acoustic module 303 may include one or more elements configured to expel water or liquid that accumulates in, for example, the acoustic cavity 311 of the module. In the present example, the acoustic module 303 includes one or more conductive elements configured to change the surface charge on portions of the acoustic module. As explained in more detail with regard to FIG. 4, below, the surface charge can facilitate movement and expulsion of the liquid from the acoustic cavity 311.

FIG. 3B depicts a cross-sectional view of an acoustic module 303 having conductive elements for expelling liquid from the module. The cross-sectional view of FIG. 3B is taken along section A-A of FIG. 1A. In particular, the acoustic module 303 includes conductive elements (350*a-d*, 360*a-d*) located proximate to the interior surfaces of the acoustic cavity 311. In this example, a first array of conductive elements 350*a-d* are located proximate to a lower region of the acoustic cavity 311, and a second array of conductive elements 360*a-d* are located proximate to an upper region of the acoustic cavity 311. Although one example configuration is depicted in FIG. 3B, conductive elements may be arranged proximate to other surfaces of the acoustic cavity 311 or proximate to other components of the acoustic module 303 that may contain liquid. Also, in other embodiments, the number of elements, the size of the elements, and the shape of the elements may vary. Also, a series of conductive elements may be located only on one (e.g., the lower) interior surface of the acoustic cavity 311.

In one example embodiment, each of the conductive elements (350*a-d*, 360*a-d*) are formed from a conductive material that is patterned into an individual electrode. In this case, the conductive elements will have a form factor that substantially conforms to a corresponding portion of the cavity. The electrodes may be formed, for example, by patterning a conductive material, such as indium tin oxide (ITO), copper, or silver on a flat, flexible substrate and then attaching the electrodes to an interior surface of the acoustic cavity 311. In some cases, the electrodes are formed as part of a laminate material having a dielectric layer and an electrode layer. In this case, the laminate material may be inserted into the acoustic cavity 311 such that the electrode layer is positioned between the interior surface of the acoustic cavity 311 and the dielectric layer. This example arrangement places the electrodes proximate to liquid that may accumulate in the cavity, and also protects the electrodes from any liquid or moisture. The electrodes may also be coated by more than one dielectric layer and/or by a protective coating. In addition to protecting the electrodes, the dielectric layer or coating may also have surface properties that facilitate interaction with liquid that may accumulate within the cavity.

In another example, the conductive elements (e.g. 350*a-d*, 360*a-d*) may be formed from a series of coils. For example, the conductive elements 350*a* and 360*a* may represent a cross-sectional view of a single coil element formed by wrapping wire or other conductive element around a portion of the acoustic cavity 311. In this case, the conductive elements will have a generally tube shaped form factor. Alternatively, the conductive elements may be formed as flat-plate coil elements. As discussed above with respect to the previous example, the coil conductive elements may also be protected from liquid by one or more dielectric layers and/or protective coatings. As previously mentioned, the dielectric layer or coating may also have surface properties that facilitate interaction with liquid that may accumulate within the cavity.

In general, each of the conductive elements (350*a-d*, 360*a-d*) of FIG. 3B are configured to generate a surface charge on a corresponding portion of the interior surface of the acoustic cavity 311. In one example, each of the conductive elements (350*a-d*, 360*a-d*) is operatively coupled to circuitry that is configured to selectively apply a charge to one or more of the conductive elements (350*a-d*, 360*a-d*). In one example, the circuitry may be configured to selectively apply a DC voltage to each of the conductive elements to generate the surface charge. In another example, the circuitry may be configured to selectively apply an AC voltage or current to each of the conductive elements to generate the surface charge.

As described in more detail below with respect to FIG. 4A-C, a positive, neutral, or negative relative surface charge may be applied using a conductive element to modify the hydrophobicity of a surface proximate to the conductive element. With reference to FIG. 3, a surface charge may be applied to the acoustic cavity 311 using a conductive element 350*a-d*, 360*a-d* to modify the hydrophobicity of a corresponding region of the acoustic cavity 311. In general, a positive charge applied to a region (by a conductive element) may reduce the hydrophobic properties of that region, which may tend to promote wetting of that region by any liquid that is nearby that region. Conversely, a negative charge applied to a region (by a conductive element) may increase the hydrophobic properties of that region, which may tend to increase the contact angle and decrease wetting by any liquid in that region. The surface charge may be selectively applied using the conductive elements (350*a-d*, 360*a-d*) to facilitate movement of the liquid within the acoustic cavity 311.

In some cases, the selective operation of the conductive elements (350*a-d*, 360*a-d*) may be used to transport any accumulated liquid toward or away from a region of the acoustic cavity 311. In one example, the conductive elements (350*a-d*, 360*a-d*) are used to selectively apply a charge to the interior surface of the acoustic cavity 311 to propel any liquid toward the acoustic port 120 of the acoustic module 303. The propelled liquid may then be expelled from the acoustic module 303 by propelling the liquid through the protective screen 315 and any openings or orifices 116 of the acoustic port 120.

As shown in FIGS. 3A-B, a protective screen 315 is located at an opening in the acoustic cavity 311. In some cases, the screen element 315 may be configured with one or more hydrophobic surfaces, such as one or more hydrophobic coatings (such as manganese oxide polystyrene, zinc oxide polystyrene, precipitated calcium carbonate, carbon-nanotubes, silica nano-coating, polytetrafluoroethylene, silicon, and so on). In some cases, a charge may also be selectively applied to the screen 315 to modify the hydrophobic properties of that element. For example, to prevent ingress of water, a negative charge may be applied to the protective screen 315, thereby increasing the hydrophobic properties of the screen 315 and repelling water away from the opening of the acoustic cavity 311.

In another example, a positive charge may be applied to the protective screen 315, thereby decreasing the hydrophobic properties of the screen, which may promote wetting of the opening of the acoustic cavity 311. This may be advantageous when expelling water from the acoustic cavity 311 by drawing water to the opening and facilitating evacuation of the acoustic cavity 311. In general, it may be advantageous to apply a positive charge to the screen 315 in conjunction with the selective application of charge using one or more of the conductive elements 350*a-d*, 360*a-d* within the cavity. Thus, in some cases, any accumulated liquid may be expelled from the orifice(s) 116 by selectively applying charge to both the interior surface of the acoustic cavity 311 and the screen 315.

In various cases, an external surface of the screen element 315 may be configured to be hydrophobic and an internal surface of the screen element may be configured to be hydrophilic, such as utilizing one or more hydrophobic and/or hydrophilic coatings (such as polyethylene glycol and so on). Such hydrophobic external surfaces may resist the passage of liquids through the screen element from the external environment into the acoustic cavity 311 whereas such hydrophilic internal surfaces may aid the passage of liquids through the screen element from the acoustic cavity to the external environment. The use of coatings may be combined with the selective application of a charge to the screen 315 to facilitate both the prevention of liquid ingress and the expulsion of liquid that may accumulate in the acoustic cavity 311.

As shown in FIGS. 3A-B, the acoustic module 303 may also include a speaker formed from a diaphragm element 310 and a voice coil 309. In cases where the acoustic module includes a speaker, one or more acoustic energy pulses may be applied to further facilitate expulsion of liquid from the acoustic module 303. In one example, the acoustic energy pulses may be generated at a frequency that is outside the audible range of a human ear. A typical range of acoustic frequencies that are audible to humans may be between 20 Hz and 20,000 Hz. Thus, the acoustic energy pulse(s) used to help expel the liquid may be less than 20 Hz or greater than 20,000 Hz. Generally, if an acoustic energy pulse is not audible to humans, a user may be unaware when such an acoustic pulse is being applied to remove liquid from the acoustic cavity 311.

As shown in FIG. 3B, the acoustic module may also include one or more sensors 314. In some cases, sensor 314 may include a pressure sensor, an optical sensor, a moisture sensor, a conductive sensor, or the like. The sensor 314 may either directly or indirectly detect the presence of liquid in the acoustic cavity 311. For example, the sensor 314 may directly sense the presence of liquid in the cavity 311 by detecting a change in optical, electrical, or moisture conditions as compared to reference condition when the acoustic cavity 311 is evacuated or empty. In another example, the sensor 314 is an acoustic sensor and may indirectly detect the presence of liquid in the acoustic cavity 311 by detecting a tone or acoustic pulse produced by the speaker or other acoustic element. In general, the presence of a liquid may dampen or alter the acoustic response of acoustic module 303. The acoustic response may be measured using the sensor 314 and compared to a reference response to detect the presence of liquid in the acoustic cavity 311 or other portions of the acoustic module 303. In the example depicted in FIG. 3B, the sensor 314 is located proximate to the cavity 311. However, another type of sensor may be used that is not proximate to the cavity 311 or not located within the acoustic module 303. For example, a microphone element of a microphone module may be used as a sensor, in some implementations.

Although a variety of different liquid removal elements (e.g., conductive elements, screen, speaker acoustic pulse) are discussed above and illustrated in the accompanying figures, it is understood that these are examples. In various implementations, one or more of the discussed liquid removal elements may be utilized in a single embodiment without departing from the scope of the present disclosure.

Further, although the electronic device is illustrated and discussed as including a processing unit and a non-transitory storage medium (e.g., elements 154 and 152 of FIG. 2) as belonging to the device, in some cases these elements may be integrated into the acoustic module. For example, in various implementations, the acoustic module may include a variety of additional components such as a controller that controls the speaker, the charge applied to respective elements of the acoustic module, and/or control other components to facilitate expulsion of liquid from the acoustic cavity. Additionally, although the examples provided above relate to an acoustic module having a speaker, similar elements and techniques could also be applied to an acoustic module having a microphone.

Figure 4A:
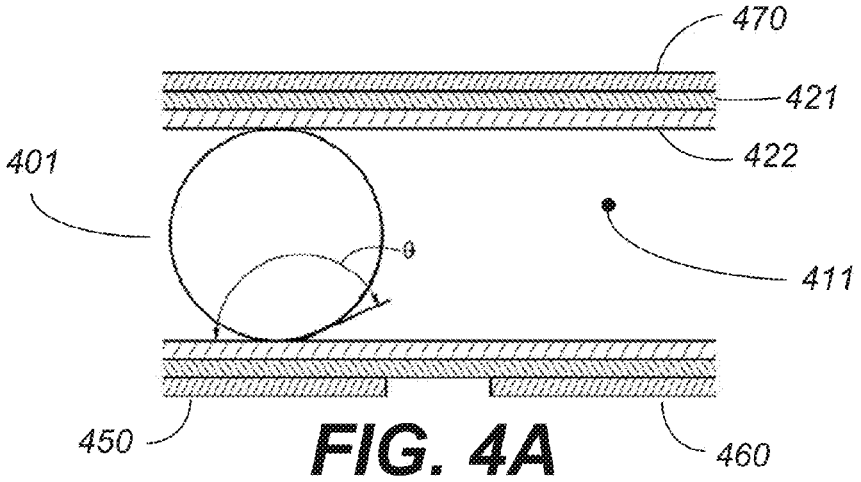
FIGS. 4A-C depict an example system of conductive elements for moving liquid disposed in a cavity.
Figure 4B:
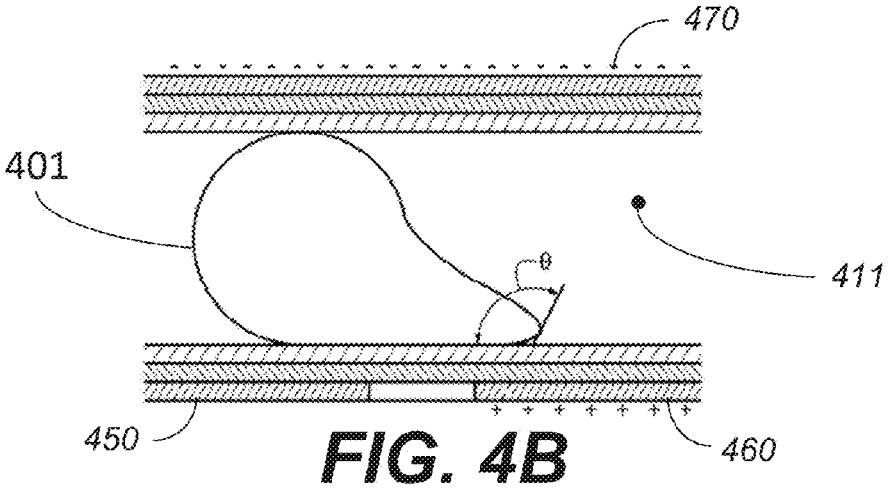
Figure 4C:
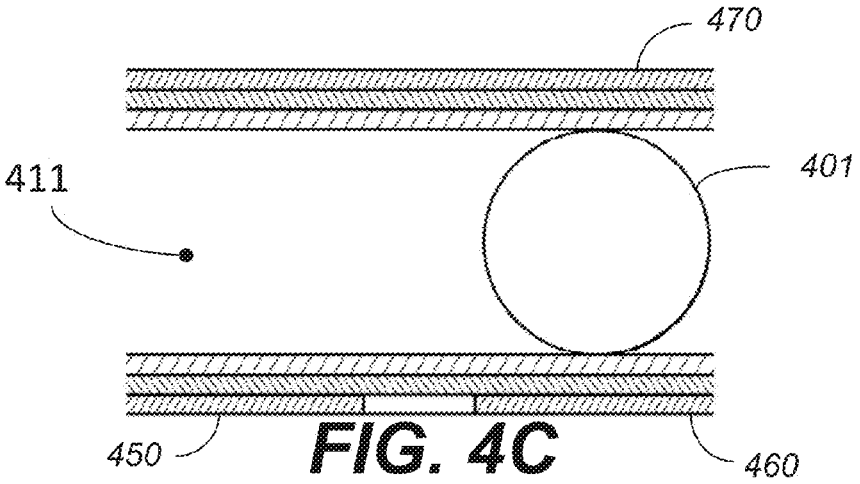

FIGS. 4A-C depict an example system of conductive elements for transporting liquid in a cavity. The elements and techniques discussed with respect to FIGS. 4A-C may be applied to facilitate movement of a liquid within an acoustic cavity, as described above with respect to FIGS. 3A-B. In particular, FIGS. 4A-C depict an example of movement of a drop of liquid within a cavity having a plurality of conductive elements located proximate to an internal surface of the cavity.

FIGS. 4A-C depict a drop of water 401 (example liquid) disposed within a cavity 411. As shown in FIGS. 4A-C, the cavity 411 includes a plurality of conductive elements 450, 460, 470 that are configured to apply a charge to an interior surface of the cavity 411. In this example, the conductive elements 450, 460 are electrodes formed from a conductive material, such as ITO, copper, or silver. In this particular example, the width of the lower electrodes 450, 460 are approximately the same as the height of the cavity 411. In other examples, the width of the lower electrodes may vary with respect to the height of the cavity 411.

As shown in FIG. 4A, the conductive elements 450, 460, 470 are formed as part of a laminate structure having a dielectric layer 421 and a hydrophobic layer 422. The dielectric layer 421 may be formed from a dielectric sheet material, including a polymide sheet, polyester sheet, mylar sheet, or the like. The hydrophobic layer 422 may be formed from a silicone sheet, fluorocarbon polymer sheet, other hydrophobic material, or a material that is coated with a hydrophobic coating. In some cases, the hydrophobic layer 422 is processed or treated to increase the hydrophobic properties of the surface. For example, the hydrophobic layer 422 may have a coating or be treated to form a micro textured-surface.

In other examples, additional layers may also be used, including, for example, a pressure sensitive adhesive (PSA) layer, a structural stiffener layer, or additional dielectric and/or hydrophobic layers. In some cases, the dielectric and hydrophobic layers are formed as a single layer from a single material having appropriate dielectric and hydrophobic properties. In yet another example, a hydrophobic layer may be omitted from one or both of the surfaces of the cavity 411. In yet another example, the conductive elements may be formed directly on the inner surface of the cavity.

As shown in FIG. 4A, both the upper and lower surfaces of the cavity 411 are lined with a hydrophobic layer. Alternatively, in some cases, one layer or both layers may be lined with a hydrophilic layer or hydro-neutral layer.

As shown in FIGS. 4A-C, a charge is selectively applied to the surface of the cavity 411 using the conductive elements 450, 460, 470 to transport the drop of water 401 through the cavity 411. More specifically, by selectively applying a charge to a region of the surface of the cavity 411, the relative surface energy of region may be changed altering the hydrophobic/hydrophilic properties of that region. In general, the shape of a liquid drop on a surface is determined, in part, by the interaction between the internal cohesive forces of the liquid (e.g., water) and the surface energy of the surface. In general, an electric charge increases the hydrophilic properties of the surface resulting in a decrease in the contact angle between a drop of water and the surface. This may also be described as a decrease in the hydrophobic properties of the surface. Additionally, by selectively applying a different electric charge or grounding an adjacent region on the surface, a non-uniform field may be formed across the liquid drop resulting in a different contact angle of the liquid drop near the adjacent region. By selectively applying charge and altering the hydrophobic/hydrophilic properties of the surface, a water drop can be drawn away from a first (hydrophobic) region and drawn toward a second (hydrophilic) region resulting in a movement of the water drop.

In some cases, a hydrophobic layer is omitted and the hydrophobic properties of the cavity are determined primarily by the charge applied to the surface of the corresponding region. In addition, one or more regions may be made substantially hydro-neutral through a combination of the cavity wall material properties and an applied charge.

FIG. 4A depicts the water drop 401 disposed between a top conductive element 470 and a bottom conductive element 450. In the example depicted in FIG. 4A, a charge is not applied using the conductive elements. Thus, the contact angle of the drop of water is determined by the natural surface energy of the surface of the cavity. In this case, the surface of the cavity is a hydrophobic material having a relatively low surface energy. As a result, the water drop 401 is characterized by having a relatively high contact angle.

FIG. 4B depicts the water drop 401 disposed between the top conductive element 470 and both of the lower conductive elements 450, 460. In the example depicted in FIG. 4B, an electrical (positive) charge is applied the conductive element 460 as compared to the neutral charge of conductive element 450. A different (negative) charge is also applied to a portion of the upper surface using the upper conductive element 470. Due to the increased surface energy produced using the conductive element 460, the contact angle of the right-side of the water drop 401 is reduced. Simultaneously, the water drop 401 minimizes or reduces wetting of the upper surface due to the different charge that is applied by the conductive element 470. As a result, the drop of water 401 is induced to wet the portion of the surface proximate to the lower conductive element 460 and move away from lower conductive element 450. In some cases, a different (negative) charge may also be applied to the lower conductive element 450 to increase the contact angle of the respective portion of the water drop 410 and further facilitate the movement of the water drop 401 toward the other lower conductive element 460. In some cases, it is not necessary to apply a different or negative charge to the upper conductive element 470 in order to facilitate movement of the water drop 401.

FIG. 4C depicts the water drop 401 disposed between a top conductive element 470 and the bottom conductive element 460. In the example depicted in FIG. 4C, a charge is not applied using the conductive elements. Thus, the contact angle of the drop of water is determined by the natural surface energy of the surface of the cavity. In this case, the surface of the cavity is a hydrophobic material having a relatively low surface energy and the water drop 401 is characterized by having a relatively high contact angle.

The sequence depicted in FIGS. 4A-C may be repeated for a series of conductive elements that are arranged along the interior surface of a cavity. In this way, a drop of water can be transported from one region of a cavity to another region. In the case of an acoustic cavity (for example, as depicted above in FIGS. 3A-B), a charge may be selectively applied to conductive elements to transport water (or another liquid) along the acoustic cavity and expel the water through an orifice at an opening of the cavity.

Figure 5:
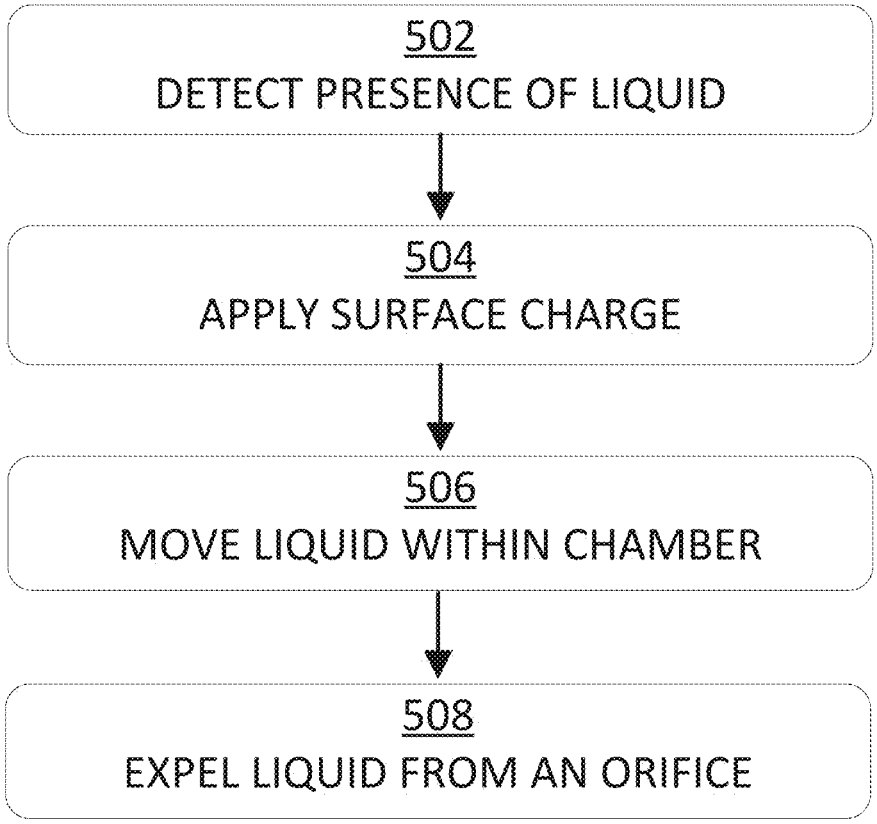
FIG. 5 depicts a flow chart or an example process for expelling liquid from a cavity.

FIG. 5 depicts an example process 500 for expelling a liquid from a cavity of an acoustic module. The process 500 may be implemented, for example, using the acoustic cavity depicted in FIGS. 3A-B. More generally, process 500 may be applied to a variety of acoustic modules, including, for example, both speaker- and microphone-type acoustic modules.

In operation 502, the presence of liquid is detected. In one example, one or more sensors are used to detect the presence of liquid within the cavity or other portion of an acoustic module. An example sensor is discussed above with respect to FIGS. 3A-B, above. As previously discussed, the sensor may include a pressure sensor, an optical sensor, a moisture sensor, a conductive sensor, or the like. In some embodiments, the microphone element of the device is used as an acoustic sensor to detect the presence of liquid in the acoustic module. The sensor may be used to directly or indirectly detect the presence of liquid in the acoustic module. For example, the sensor may directly sense the presence of liquid in the module by detecting a change in optical, electrical, or moisture conditions as compared to reference conditions when the module is dry. In another example, an acoustic sensor may be used and may indirectly detect the presence of liquid in the acoustic cavity by detecting a tone or acoustic pulse produced by the speaker or other acoustic element. In general, the presence of a liquid may dampen or alter the acoustic response of an acoustic module. The acoustic response may be measured using the sensor and compared to a reference response to detect the presence of liquid in the acoustic cavity or other portions of the acoustic module. As discussed previously, a microphone element of a microphone module may also be used as a sensor for purposes of operation 502.

If the presence of liquid is detected in operation 502, operation 504 is performed. In operation 504, a charge is applied to an element of the acoustic module. In one example, a charge is applied to a portion of an interior surface of a cavity of the acoustic module. For example, a surface charge may be applied using at least one conductive element that is proximate to the interior surface. Typically, the surface charge changes the hydrophobicity of the surface due to the change in surface energy caused by the application of a surface charge.

In some cases, a charge is applied to a series of conductive elements in a synchronized manner. For example, a series of conductive elements may be arranged along a direction of the surface of the cavity. A charge may be applied to each of the conductive elements in sequence resulting in a surface charge that moves along the direction of the surface. Additionally, multiple charges may be simultaneously applied using multiple conductive elements arranged along the surface of the cavity.

In operation 506, the liquid is moved within the cavity. As discussed above with respect to FIGS. 4A-C, applying a charge to a region of a surface of the cavity may change the hydrophobicity of that region of the surface. By selectively applying a charge using one or more conductive elements, the change in hydrophobicity may tend to change the contact angle of a respective portion of the liquid tending to move it toward or away from a corresponding region of the surface. In one example, a positive charge is applied using a first conductive element to reduce the hydrophobicity of a corresponding region of the cavity. The decrease in the relative hydrophobicity may draw or attract liquid to that region by decreasing the contact angle and promoting wetting of the region. In addition, a different charge may be applied to a second conductive element that is proximate to the first conductive element resulting in a relative increase in the hydrophobicity of a corresponding region of the cavity. The increase in the relative hydrophobicity may increase the contact angle, decreasing wetting of the region and facilitate movement of the liquid way from that region and toward an area of lower hydrophobicity. Thus, selective application of a charge in operation 504 can be used to move the liquid within the cavity.

In some cases, a series of conductive elements are used to sequentially apply a charge down a length of the cavity. In this case, the charge, and thus the change in hydrophobic properties, may propagate along the surface like a wave. The charge wave may be used to drive a portion of the liquid along the length of the cavity. In some cases, multiple charge waves are used to drive the liquid toward one end of the cavity.

In some cases, one or more conductive elements may be used to generate a charge that draws a portion of the liquid toward the acoustic element (e.g., speaker). In this case, some of the liquid can be held back, while the remainder of the liquid is drawn toward the opening of the cavity for expulsion. This technique may be advantageous when, for example, the volume of liquid trapped in the cavity is too large to efficiently evacuate all at once. In some cases, this technique is repeated resulting in small portions of liquid being moved toward the opening of the cavity, while some portion of liquid is held back against the acoustic element or other region of the cavity.

As part of operation 506, additional techniques may be applied to assist with the movement of the liquid. For example, if the acoustic module includes a speaker element, one or more acoustic energy pulses may be generated in conjunction with the application of the charge in operation 504. In some cases, the one or more acoustic pulses helps to drive a portion of the liquid toward one end of the cavity. In another example, a positive charge may be applied to the protective screen or other element to facilitate movement of the liquid toward the opening of the cavity.

In operation 508, at least a portion of the liquid is expelled from the cavity through an orifice. In one example, the movement of the liquid of operation 506 is sufficient to drive at least a portion of the liquid out of the cavity. In some cases, multiple techniques are applied to expel the liquid from the cavity and through the orifice. For example, a charge may be applied using one or more conductive elements that are located proximate to the opening of the cavity. In conjunction, a positive surface charge may be selectively applied to modify the hydrophobic properties of the protective screen. For example, a positive charge may be applied to the protective screen, reducing the hydrophobic properties of the screen, thereby facilitating passage of liquid through the screen. Additionally, one or more acoustic energy pulses may be generated facilitating the expulsion of at least a portion of the liquid through an orifice and out of the acoustic cavity.

In some cases, additional optional operations may be performed to monitor the liquid removal process. For example, in some cases, a tone or acoustic signal may be generated by the speaker or other acoustic element of the acoustic module. Because the presence of liquid may affect the acoustic response of the acoustic module, the tone or acoustic signal may indicate the presence or quantity of liquid remaining in the acoustic module. In one example, an acoustic sensor (e.g., a microphone) may be used to measure and quantify the tone or acoustic signal. The measurement of the tone or acoustic signal produced by the acoustic module may be compared to a known reference measurement that represents the acoustic response of the acoustic module when dry. Based on the comparison between the measured response and the reference measurement, the presence of liquid can be detected, and/or the quantity of any remaining liquid may be estimated.

In some cases, one or more operations of process 500 may be repeated based on a detected presence of liquid remaining in the acoustic module. In some cases, one or more operations of process 500 are performed until there is no longer liquid detected in the acoustic module.

Although the method is illustrated and described above as including particular operations performed in a particular order, it is understood that this is an example. In various implementations, various configurations of the same, similar, and/or different operations may be performed without departing from the scope of the present disclosure.

By way of a first example, the process 500 is illustrated and described as performing liquid extraction operations in response to the detection of the presence of liquid in the acoustic cavity of the acoustic module. Alternatively, the liquid extraction operations 504, 506, and 508 may be performed without detecting the presence of liquid in the acoustic cavity. For example, one or more of the liquid extraction operations 504, 506, or 508 may be performed on a regular interval to prevent or reduce the accumulation of liquid in the acoustic module. Additionally, one or more of the liquid extraction operations 504, 506, or 508 may be performed when the device is idle or being charged.

By way of a second example, the process 500 is illustrated and described as performing a liquid extraction operation within a cavity of an acoustic module. However, the operations of process 500 may also be used to evacuate other regions of an acoustic module. Furthermore, the operations of process 500 may be performed on other types of enclosed cavities that are not associated with an acoustic module.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product or software, that may include a non-transitory machine-readable medium having stored thereon instructions, which may be used to program a computer system (or other electronic device) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An acoustic module, comprising:

an acoustic element;

a cavity acoustically coupled to the acoustic element;

a first conductive element configured to generate a first surface charge on a first region of an interior surface of the cavity; and a second conductive element configured to generate a second surface charge on a second region of the interior surface of the cavity, wherein the first and second charge on the first and second regions of the interior surfaces of the cavity may be selectively applied to facilitate movement of a liquid held within the cavity.

2. The acoustic module of claim 1, wherein the first conductive element is formed from a first electrode that is proximate to an interior surface of the cavity, and wherein the second conductive element is formed from a second electrode that is proximate to the interior surface of the cavity and proximate to the first electrode.

3. The acoustic module of claim 2, wherein the first and second electrodes are separated from the interior surface of the cavity by a dielectric layer.

4. The acoustic module of claim 1, wherein:

the first charge is a positive charge resulting in a decrease in the hydrophobicity of the first region of the interior of the surface of the cavity, and the first charge facilitates movement of the liquid toward the first region of the interior surface of the cavity.

5. The acoustic module of claim 1, wherein:

the first charge is a positive charge resulting in a decrease in the hydrophobicity of the first region of the interior of the surface of the cavity, and the second charge is a negative charge resulting in an increase in the hydrophobicity of the second region of the interior of the surface of the cavity, and the first and second charge facilitates movement of the liquid toward the first region of the interior surface of the cavity.

6. The acoustic module of claim 1, wherein the first and second conductive elements are located on a lower surface of the cavity, the acoustic module further comprising:

a third conductive element configured to generate a first surface charge on a third region of an interior surface of the cavity, wherein the third conductive element is located on an upper surface of the cavity.

7. The acoustic module of claim 1, further comprising:

a third conductive element configured to generate a third surface charge on a third region of an interior surface of the cavity; and a fourth conductive element configured to generate a fourth surface charge on a fourth region of the interior surface of the cavity, wherein the first, second, third, and fourth charges may be selectively applied to facilitate movement of a liquid held within the cavity.

8. The acoustic module of claim 1, wherein the first and second conductive elements are formed from an electrode that substantially conforms to the shape of the cavity.

9. The acoustic module of claim 1, wherein the first and second conductive elements are coil elements formed from a coil of conductive wire.

10. The acoustic module of claim 1, wherein the acoustic element is a speaker element.

11. The acoustic module of claim 1, wherein the speaker element is configured to generate an acoustic pulse that facilitates movement of the liquid within the cavity.

12. The acoustic module of claim 1, further comprising:

a screen element located at an opening in the cavity, and wherein the screen element is configured to selectively apply a surface charge to a surface of the screen element to modify the hydrophobicity of the surface of the screen element.

13. An electronic device, comprising:

a housing having at least one acoustic port having an orifice; and an acoustic module coupled to the at least one acoustic port, the acoustic module comprising:

an acoustic element;

a cavity acoustically coupled to the acoustic element;

a first conductive element configured to generate a first surface charge on a first region of an interior surface of the cavity; and a second conductive element configured to generate a second surface charge on a second region of the interior surface of the cavity, wherein the first and second charges on the first and second regions of the interior surfaces of the cavity may be selectively applied to facilitate movement of a liquid held within the cavity.

14. The acoustic module of claim 13, wherein the electronic device is a mobile telephone and wherein the acoustic element is one or more of: a speaker element or a microphone element.

15. The acoustic module of claim 13, wherein the electronic device is a wearable device and wherein the acoustic element is one or more of: a speaker element or a microphone element.

16. An acoustic module, comprising:

a housing defining an acoustic port;

an acoustic element coupled to the acoustic port by an acoustic cavity; and an array of conductive elements configured to generate a localized surface charge within the acoustic cavity, wherein the array of conductive elements are configured to selectively apply the localized surface charge resulting in a change in the hydrophobicity of a respective region of the interior of the surface of the cavity, and the change in hydrophobicity induces movement of the liquid along the interior surface of the cavity.

17. The acoustic module of claim 16, wherein:

the array of conductive elements are located proximate to an interior surface of the cavity; and the array of conductive elements are separated from the interior surface of the cavity by a dielectric layer.

18. The acoustic module of claim 16, wherein the array of conductive elements are arranged in opposing pairs along a length of the cavity.

19. The acoustic module of claim 16, wherein:

the array of conductive elements are configured to apply a positive charge resulting in a decrease in the hydrophobicity of a respective region of the interior of the surface of the cavity, and the positive charge facilitates movement of the liquid toward the respective region of the interior surface of the cavity.

20. The acoustic module of claim 16, wherein:

the array of conductive elements are configured to apply a positive charge resulting in a decrease in the hydrophobicity of a first region of the interior of the surface of the cavity, and the array of conductive elements are configured to apply a negative charge resulting in an increase in the hydrophobicity of a second region adjacent to the first region to facilitate movement of the liquid toward the first region.

* * * * *